US005760348A

United States Patent [19]

Heuser

[11] Patent Number: 5,760,348

[45] Date of Patent: Jun. 2, 1998

[54] NOISE ATTENUATING APPARATUS

[76] Inventor: Stephen Glen Heuser, P.O. Box 76, Lawrence, Mich. 49064

[21] Appl. No.: 689,840

[22] Filed: Aug. 15, 1996

Related U.S. Application Data

[63] Continuation of Ser. No. 234,869, Apr. 28, 1994, abandoned.

[51] Int. Cl.[6] ..... F01N 1/08

[52] U.S. Cl. ..... 181/272; 181/275; 181/230

[58] Field of Search ..... 181/229, 230, 181/232, 239, 238, 255, 267, 268, 269, 272, 282, 275

[56] References Cited

U.S. PATENT DOCUMENTS

| | | | |
|---|---|---|---|
| 700,785 | 5/1902 | Kull | 181/239 |
| 2,919,761 | 1/1960 | Smith | 181/272 |
| 3,999,624 | 12/1976 | Treftc et al. | 181/282 X |
| 4,105,090 | 8/1978 | Tachibana et al. | 181/272 X |
| 4,109,750 | 8/1978 | Wirt | 181/224 |
| 4,415,059 | 11/1983 | Hayashi | 181/250 |
| 4,416,350 | 11/1983 | Hayashi | 181/272 |
| 4,595,073 | 6/1986 | Thawani | 181/272 X |
| 4,635,752 | 1/1987 | Jennings | 181/241 |
| 4,637,891 | 1/1987 | Fukuda | 181/265 |
| 5,378,435 | 1/1995 | Gavoni | 181/272 |

OTHER PUBLICATIONS

Compressed Air, p. 23, 1971 Brochure fron Nelson Industries, Stoughton WI.

Morse, Vibration and Sound, p. 356, 1948 McGraw–Hill Book Company, Inc, New York/Toronto/London.

*Primary Examiner*—Khanh Dang

*Attorney, Agent, or Firm*—Flynn, Thiel, Boutell & Tanis, P.C.

[57] ABSTRACT

Noise attenuator apparatus for use on a noise source including an exhaust inlet assembly using sound attenuators being equal to the exhaust pressure needs of the noise source whereby the sum total area of all smaller openings of the attenuators is equal to the exhaust volume needs of the noise source. Surrounding the inner or primary assembly, a sealed partition of any dimension containing an inner chamber which allows for the release of exhaust gas through any number of attenuators of which the smallest exit openings are equal to the exhaust volume needs of a noise source divided by the actual number of sound attenuators. The preceding assembly contained within this secondary chamber being contained or shrouded by an outer casing made from any number of plates or curved pieces whereby the primary and secondary chambers being contained by an outer casing through which the exhaust gas exits by way of measured openings or attenuators.

16 Claims, 11 Drawing Sheets

NOISE ATTENUATING APPARATUS

This application is a continuation of U.S. Ser. No. 08/234,869, filed Apr. 28, 1994, now abandoned.

FIELD OF THE INVENTION

This invention pertains generally to the field of noise attenuating apparatus, and particularly to mufflers for internal combustion engines for power implements such as lawn mowers, snowblowers, generators or any other implement where noise generation has deleterious consequences on the operator or the environment.

BACKGROUND OF THE INVENTION

In general, noise abatement systems, silencers, or mufflers, of the type to which the instant invention is directed include a plurality of chambers for expansion or resonance. In the prior art, such as U.S. Pat. No. 4,415,059, issued to Yoshimasa Hayashi, partitions are arranged in a longitudinal direction while the interiors of the chambers are interconnected by tubes or perforations which allow combustion gasses to flow through the chambers in a predetermined order. The combustion gasses blow out of the final chamber into the ambient air via an outlet pipe. Another approach to sound attenuation is that suggested in U.S. Pat. No. 4,109,750, issued to Leslie Spencer, whereby an acoustically lined chamber of varying cross-sectional shape is employed to simultaneously maintain an essentially constant acoustic resistance while obtaining a scaled acoustic reactance, thereby attenuating specific frequencies of interest.

SUMMARY OF THE INVENTION

The instant invention relates to a noise attenuation apparatus for an internal combustion engine, but is not limited to such engines. The invention can be applied to any source of sound. To name a few, this would include: an air compressor intake module, a vacuum cleaner intake module, such large scale systems as steam turbines or generators, pumps used on air conditioners, fans associated with grain driers or the like, motors powering jack-hammers as well as mechanical systems such as the jackhammer tool head that strikes a pavement or concrete surface as well as tires moving across such a surface.

The noise attenuation apparatus is simple in structure and thereby produced by streamlined manufacturing steps. The instant invention requires no acoustical lining as in the aforementioned prior art and has a shape conducive to the simple manufacturing steps to be detailed in this disclosure.

The instant invention includes a plurality of expansion or resonance chambers divided by partitions which are arranged concentrically, or where non-circular, for example pyramidal, align the chambers in a nested fashion. Each chamber is connected to a subsequent chamber by a plurality of sound attenuators which conduct incoming gasses to said subsequent chambers through a larger opening from the innermost concentric body to a smaller opening toward the outermost concentric body. The gasses are vented from a final chamber via a plurality of open holes or sound attenuators. These sound attenuators allow prescribed restriction for the exhaust gasses as they exit from each chamber to the succeeding chamber. Each chamber is further described to include an inlet tube which passes through each intermediate chamber wall and terminates where the inlet tube inputs gasses into the innermost chamber.

In accordance with the invention, the exhaust gasses are intended to exit from each chamber to the succeeding chamber through a prescribed plurality of sound attenuators and finally into the ambient environment. The sound attenuators have a total cumulative volumetric dimension whereby their cumulative exit volume corresponds to an exhaust gas flow rate prescribed by the specifications of the noise source so that the instant noise attenuation apparatus shall be utilized to conduct he exhaust gases to the ambient environment while reatly attenuating the noise.

DETAILED DESCRIPTION OF THE INVENTION

Figure 1:
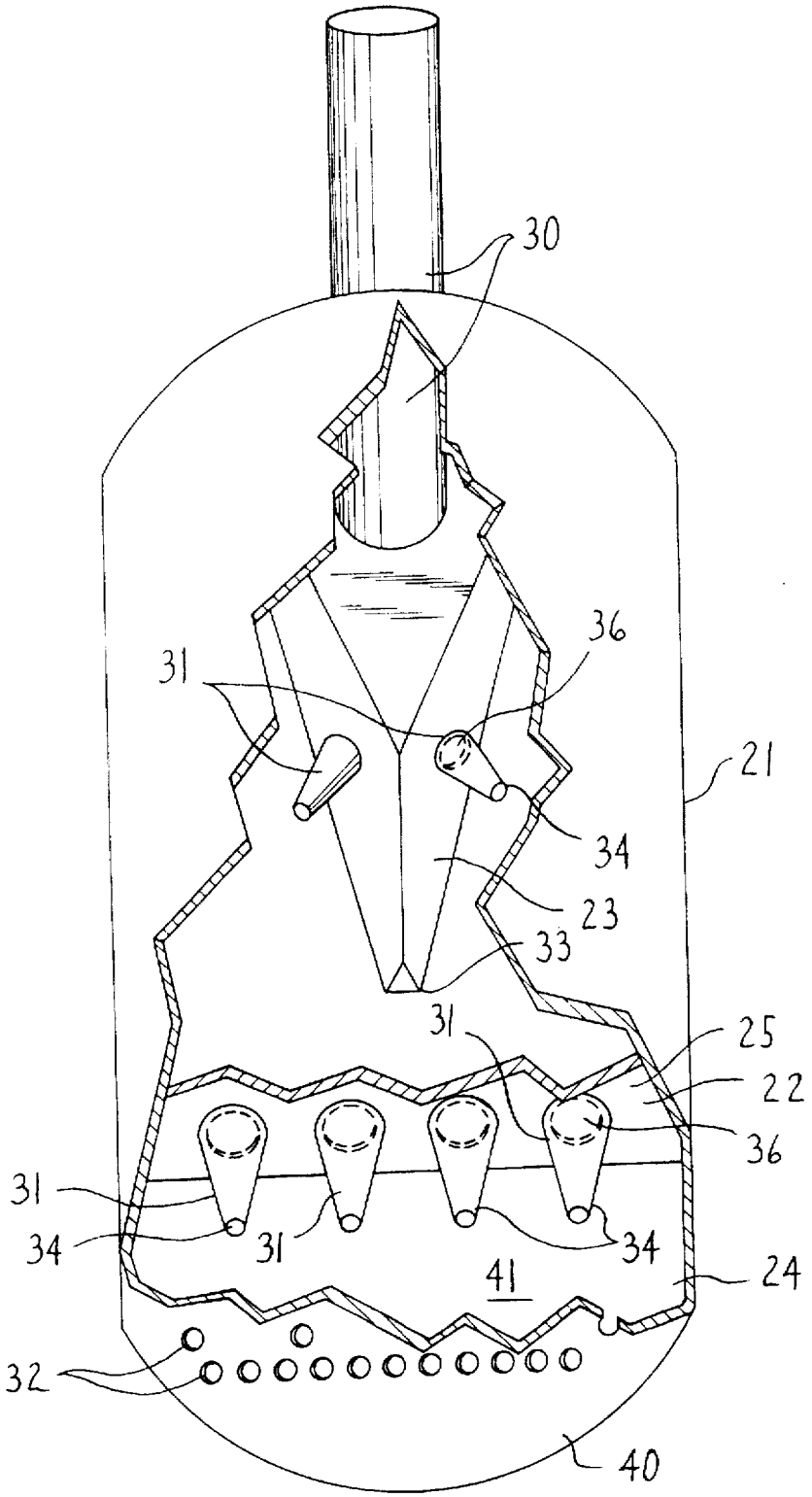
FIG. 1 is a front perspective view, partially broken away, of a sound attenuating apparatus in accordance with the invention.

With reference to the drawings, an apparatus for carrying out the attenuation of noise from a source of noise such as an internal combustion engine, a fan, pump, hammer, etc., is shown generally at 20 in FIG. 1, with the apparatus being partially cut away to illustrate the interior. The apparatus 20 includes an enclosure having walls defining a shroud 21 through which an exhaust port 30 from an internal combustion engine passes. More particularly, the walls of the shroud 21 define the exterior portions of the chamber walls of an intermediate chamber 22 and an outermost chamber 24 which chambers are separated one from the other by a further chamber or partition wall 25 extending across the hollow interior of the shroud 21. The further chamber or partition wall 25 preferably serves as a portion of the chamber walls of both the intermediate chamber 22 and the outermost chamber 24 and is formed from a downwardly extending section of a metal sheet 38 (FIG. 3*a*) as will be described hereinafter. The port 30 is the inlet to the noise attenuating apparatus and it directs gasses into the innermost chamber 23 which is disposed within the intermediate chamber 22 in communication therewith. Shown also in FIGS. 2*a*, 2*b*, 2*c* and 2*d*, the innermost chamber 23 is constructed of a plurality of substantially flat sheets of conventional materials, e.g., steel, copper, aluminum, stainless steel or ceramics, etc. which are fastened together to form the chamber wall thereof, preferably by welding, but not limited to this type of fastening, and perforated by a sound attenuator 31 having a passage therethrough. The shape of the sound attenuator is conical or pyramidal such that the diameter of the orifice 36 at the inlet end is greater than the diameter of the orifice 34 of the outlet end to provide a true conical horn without flare affecting the attenuation of sound. Thus, each sound attenuator 31 narrows or tapers from the orifice 36 to the orifice 34. As used herein, the inlet end of a sound attenuator is the end closest to a preceding chamber and the outlet end is the end closest to a succeeding chamber. The compression of the sound wave will cause an inverted resonance and if the terminating impedance is not totally restricted, as in a closed tube, wave components of a substantially homogeneously reflected sound wave approaching the point of resonance are blurred and canceled by superposition with any oncoming sound waves. Interference is the physical effect of this superposition. Recall the case of two waves, $y_1$ and $y_2$, having the same frequency, $\omega$, but different amplitudes, A, and a phase difference, $\phi$. If:

$$Y_1=A_1 \sin(kx-\omega t-\phi)$$

and $$Y_2=A_2 \sin(kx-\omega t)$$

then the resultant wave is $y=y_1+Y_2$. This is expressed as:

$$y=y_1+Y_2=A \sin(kx-\omega t-\alpha).$$

Expanding, the resultant amplitude is given by:

$$A^2=A_1^2+A_2^2+2A_1A_2 \cos\phi.$$

The resulting amplitude of the combined waves is at a maximum when $\phi=0$ or $\phi$ is any even multiple of $\pi$. Conversely, the waves interfere destructively when $\phi=\pi$ or any odd multiple of $\pi$. Since there is no other reason for a phase difference to be introduced to the sound waves propagating from a single source as is the case for this invention, the source of the phase difference comes from the different paths lengths followed by the waves. Thus, the geometry of the sound attenuators forces a destructive interference pattern on the sound waves moving through the noise attenuating apparatus of the instant invention.

The mathematical equations used to define the diminution of sound in conical forms would lead us into the far reaches of differential geometry, requiring a complete knowledge of the properties of the sound wave equation in three dimensions. Nevertheless, the approach taken to design the preferred embodiment 20 of this noise attenuating apparatus uses these sound attenuators 31 to their greatest advantage to both attenuate noise and to control backpressure. The noise attenuating apparatus of the instant invention is capable of operating over a wide range of internal combustion engine backpressure requirements by gauging the size of the orifice 34 of the outlet end of each sound attenuator 31 and an outlet port 33 to provide the backpressure.

Figure 2A:
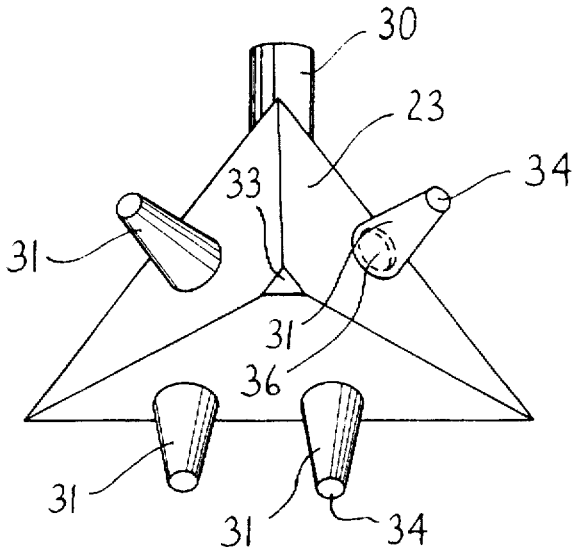
FIG. 2*a* is a front perspective view of an innermost chamber which may be utilized in the invention.
Figure 2B:
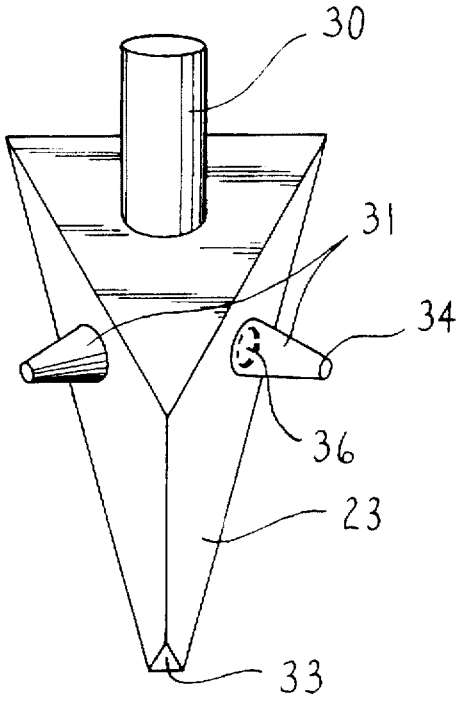
FIG. 2*b* is a top view of the innermost chamber which may be utilized in the invention.
Figure 2C:
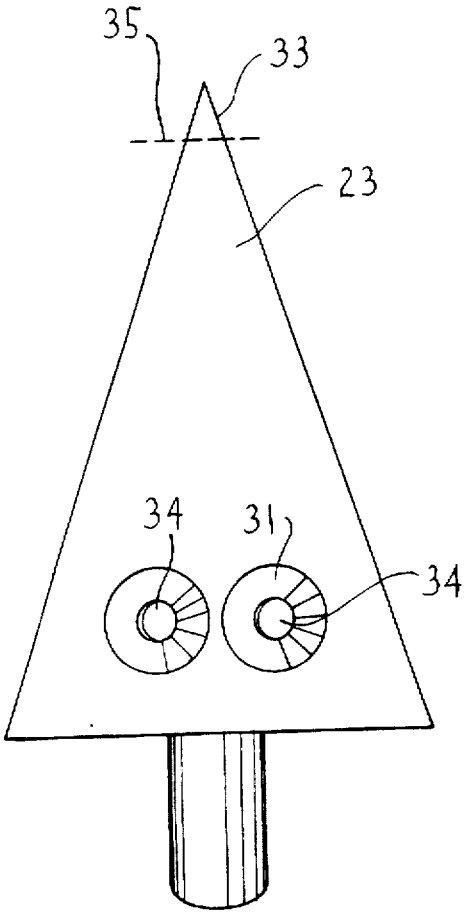
FIG. 2*c* is a bottom view of the innermost chamber which may be utilized in the invention.
Figure 2D:
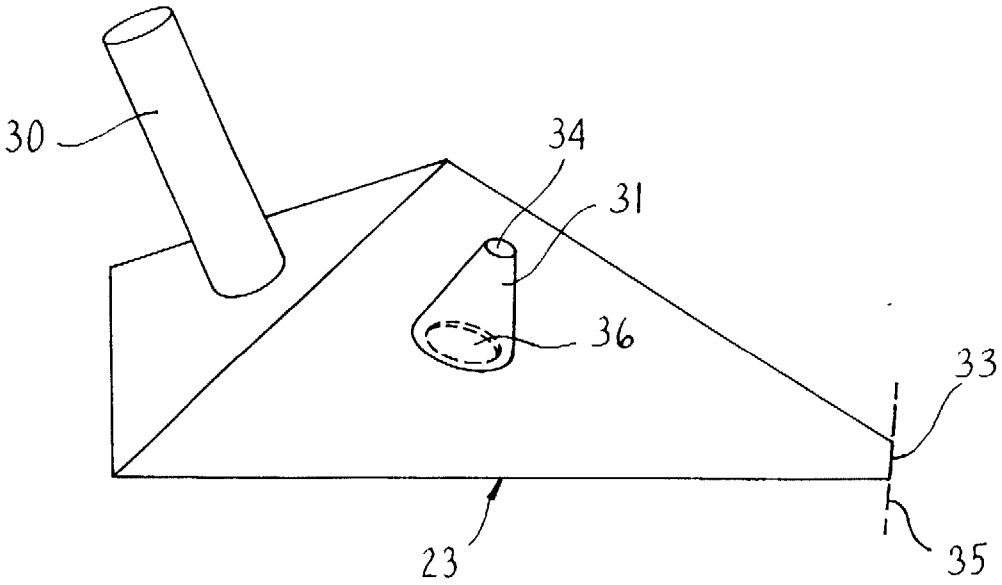
FIG. 2*d* is a side perspective view of the innermost chamber which may be utilized in the invention.

The innermost chamber 23 is further constructed to include an outlet port 33 of a size dictated by available outlet for gas flow through the inverted megaphone-like orifices 34 combined with the outlet port 33 and dictated by the backpressure needs prescribed by the specification of an internal combustion engine or other sound source that the instant noise attenuation apparatus shall be used in combination with. The range of backpressure requirements to be accommodated can be broadened by enlarging or restricting the outlet port 33 by adjusting the cut made along a line 35 as depicted in FIG. 2*c* and FIG. 2*d*.

Figure 3A:
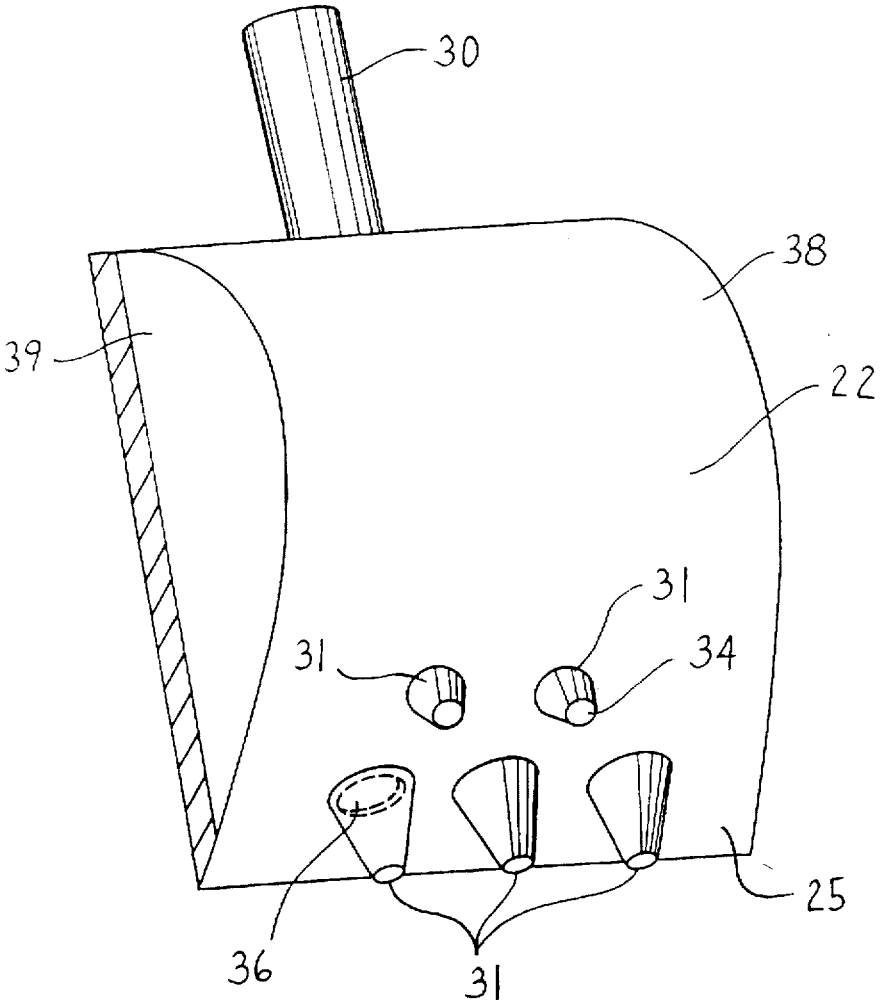
FIG. 3*a* is a top perspective view of an intermediate chamber which may be utilized in the invention.
Figure 3B:
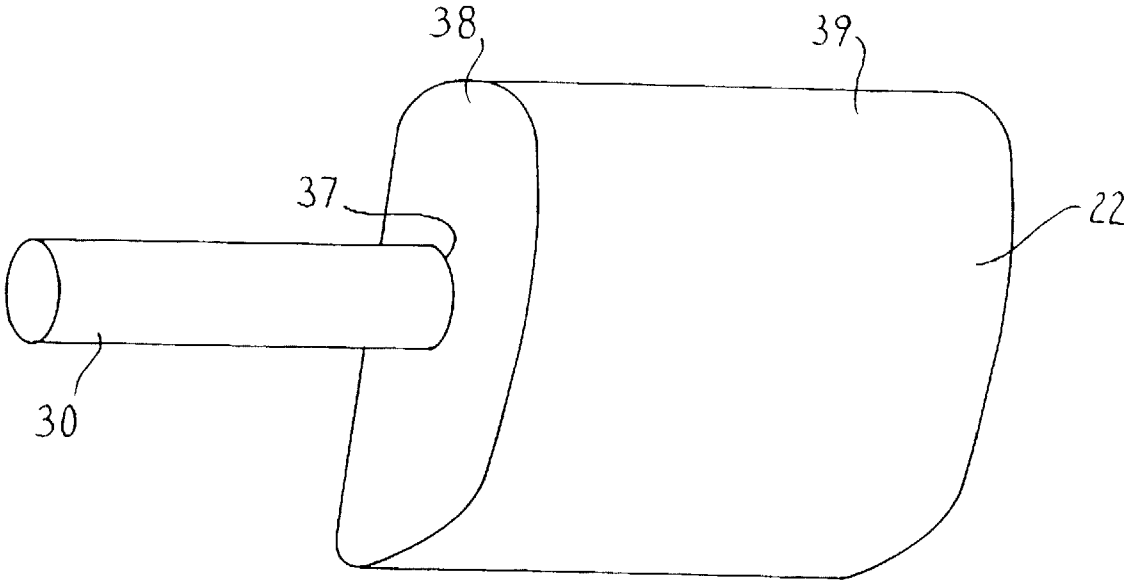
FIG. 3*b* is a bottom perspective view of the intermediate chamber which may be utilized in the invention.
Figure 3C:
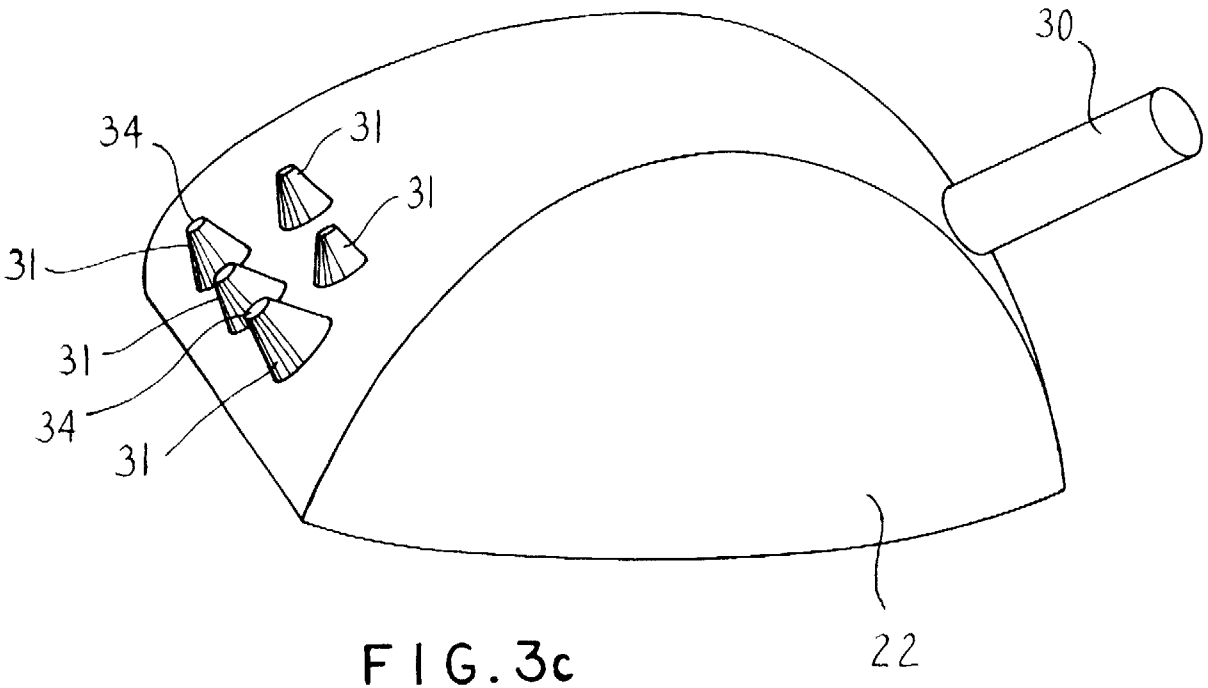
FIG. 3*c* is a side perspective view of the intermediate chamber which may be utilized in the invention.
Figure 3D:
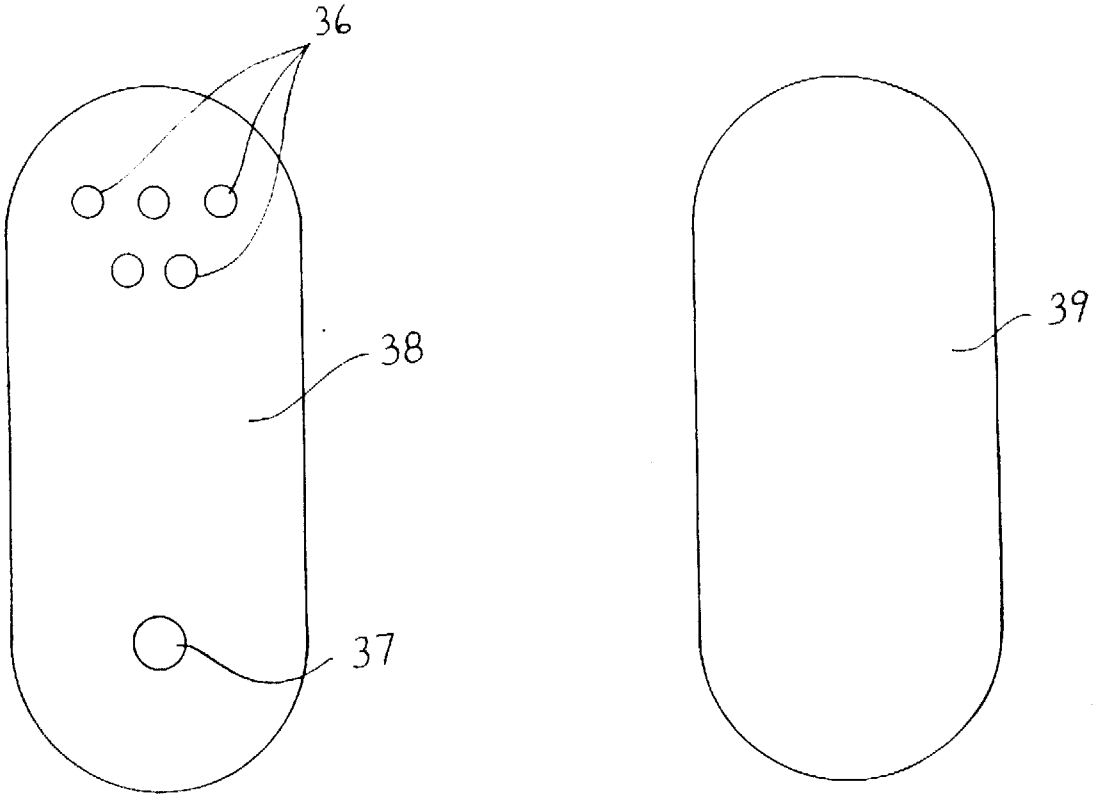
FIG. 3*d* shows flat sheets that can be used to prepare a shroud of the sound attenuating apparatus.

The outlet port 33 is a means to connect the innermost chamber 23 to the intermediate chamber 22. The chamber walls defining the intermediate chamber 22 are constructed of a plurality of substantially flat sheets of conventional malleable materials, e.g., steel, copper, aluminum or stainless steel, etc, as shown in FIGS. 3*a*, 3*b* and 3*c*. Using substantially flat sheets 38 and 39 (FIG. 3*d*) of conventional malleable materials and wrapping these shapes into the configuration of the intermediate chamber 22 and then fastening, for example welding or riveting, etc., is one useful way to form the intermediate chamber 22. Once constructed, a forward portion of the sheet 38 defines the chamber or partition wall 25 between the intermediate chamber 22 and the outermost chamber 24 while the remaining portions of the sheets 38 and 39 define a rearward portion of the shroud 21. The exhaust port 30 can be fastened to and protrude through an opening 37 in one flat sheet 38 of malleable material while the sound attenuators 31 can be fastened to the outer surface of the intermediate chamber 22 fixed at the openings 36 prepared in one flat sheet 38 or malleable material.

Figure 4A:
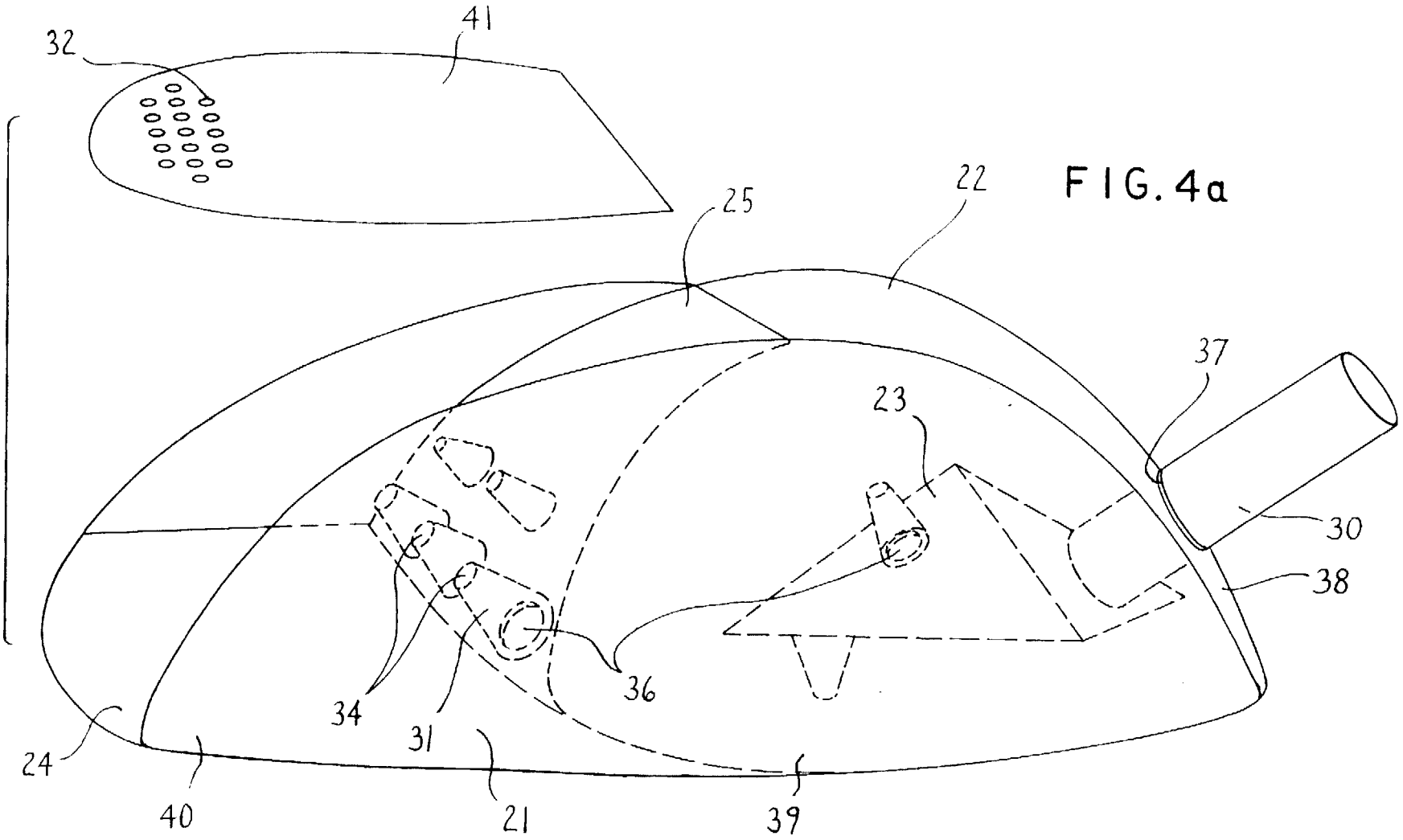
FIG. 4*a* is an exploded composite side view showing an outermost chamber which is defined by the front of the shroud for the invention. A phantom side view of the intermediate and innermost chambers which may be utilized in the invention is also depicted in FIG. 4*a*.
Figure 4B:
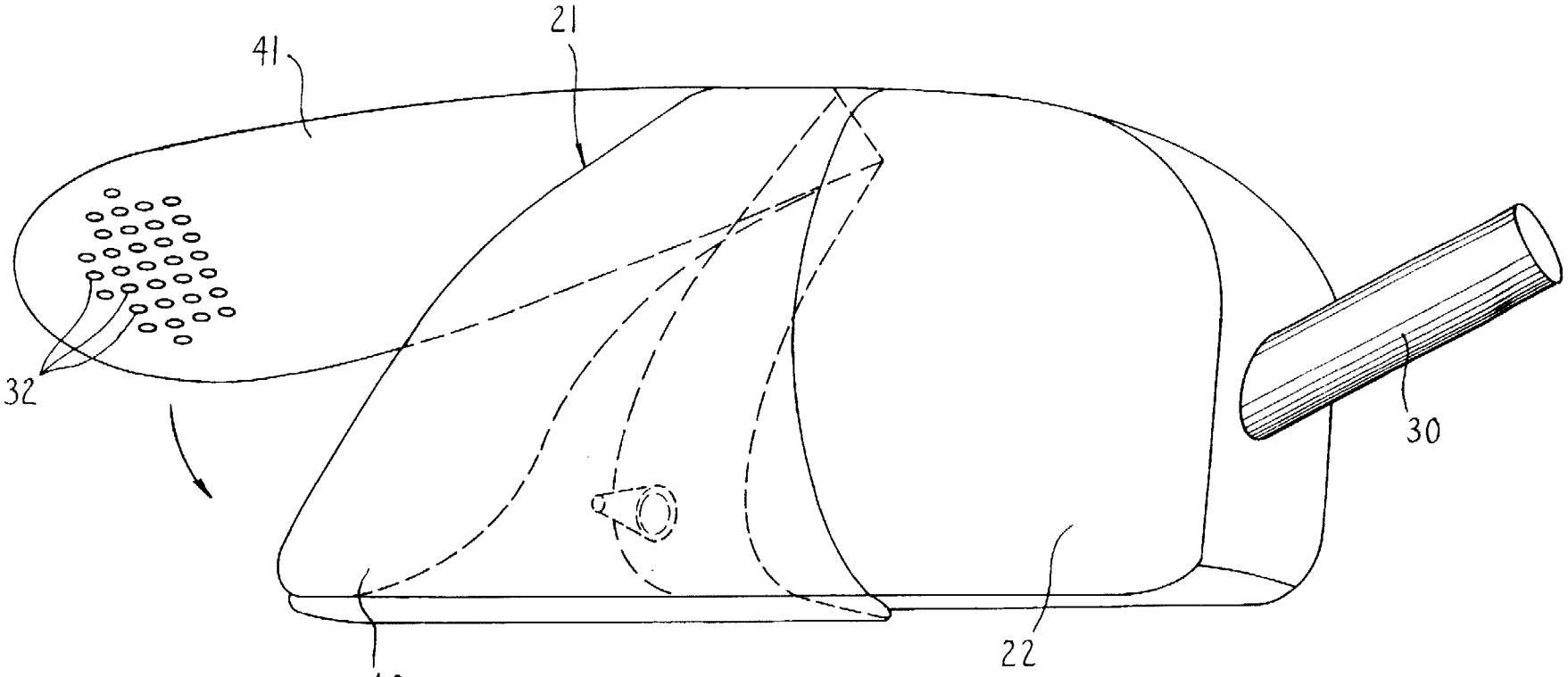
FIG. 4*b* is a side view of the outermost chamber being formed by the shroud for the invention.

FIG. 4*a* shows one way that the innermost chamber 23 shown in phantom is encased inside the intermediate chamber 22 with the outermost chamber 24 of the shroud 21 being formed on the forward end of the intermediate chamber 22 by additional sheets 40 and 41 one of which contains a plurality of port holes 32 defining passages to exhaust the gasses into the ambient environment. In the apparatus shown in FIG. 4*a*, the exhaust gas enters at the end of the inlet tube 30, it passes through the shroud 21 into the innermost chamber 23 and passes through the sound attenuators 31 and into intermediate chamber 22. The gasses then pass through the second set of sound attenuators 31 into the outermost chamber 24 of the shroud 21 and exit from the shroud 21 through the holes 32 into the ambient air. Using the substantially flat sheets 40 and 41 of a conventional malleable material and wrapping these shapes into the configuration of the forward portion of the shroud 21 and then also wrapping this portion of the shroud around the front end of the intermediate chamber 22 as shown in FIG. 4*b* and then fastening, for example welding or riveting, etc., the sheets 40 and 41 to the intermediate chamber 22 is one exemplary way of forming the sound attenuating apparatus 20. The relative shaping of the shroud 21 is depicted in FIG. 4*b*.

While one intermediate chamber 22 is illustrated, any number of additional intermediate chambers can be formed in the shroud 21 with each additional chamber being connected to an adjacent chamber by a plurality of the conical sound attenuators. In such instance, the larger orifice 36 of the sound attenuator is connected to the adjacent chamber on the side nearest the exhaust port 30 and the smallest orifice 34 is connected to the next adjacent chamber on the side nearest the port holes 32.

This device is also useful for sound attenuation in any situation where volumes of gasses or liquid fluids are drawn or expelled across a surface or where contact produces an audible resonation in a free or held gas or liquid fluid medium such as gas and water discharge from outboard motors or jet skis.

It is understood that the invention is not confined to the illustrative embodiment described herein, but embraces all such modified forms thereof as come within the scope of the following claims.

I claim:

1. A noise attenuating apparatus comprising:

(a) a shroud;

(b) a first chamber formed in said shroud at least by a first chamber wall mounted within said shroud and having inlet means in communication therewith for receiving a fluid flow into said first chamber;

(c) a second chamber formed by said shroud and at least a portion of said first chamber wall of the first chamber, said noise attenuating apparatus having outlet means defining a passage in communication with said second chamber for communicating said second chamber with the ambient environment; and (d) communicating means extending through said first chamber wall for providing communication between said first chamber and said second chamber for passage of the fluid flow from said inlet means to said second chamber, wherein said communicating means comprise a plurality of sound attenuators connected to said first chamber wall so as to project therefrom, wherein each said sound attenuator has a longitudinal passage therethrough that is defined by an interior surface and extends between a first orifice nearest said inlet means which receives the fluid flow from said inlet means and a second orifice farthest away from said inlet means from which the fluid flow passes into said second chamber, each said sound attenuator being tapered so as to narrow from said first orifice to said second orifice wherein the size of said first orifice in each said sound attenuator is greater than the size of said second orifice in each said sound attenuators said interior surface being substantially imperforate and elongate so that sound waves are reflected by said interior surface to effect destructive resistance of said sound waves during passage therethrough from said first chamber to said second chamber.

2. The noise attenuating apparatus of claim 1, wherein said shroud is defined by a plurality of flat sheets of a material which have cooperating U-shapes, said flat sheets being joined together to define at least said shroud of the noise attenuating apparatus.

3. A noise attenuating apparatus according to claim 1, wherein each said sound attenuator is conical shaped.

4. A noise attenuating apparatus according to claim 1 wherein the first chamber additionally has an outlet port defining a passage through said first chamber wall between said first and second chambers.

5. A noise attenuating apparatus according to claim 1, wherein said sound attenuators taper without flare.

6. A noise attenuating apparatus according to claim 1, wherein an end of said sound attenuator which defines said first orifice is mounted to said first chamber wall, said sound attenuator projecting in a downstream direction away from said first chamber wall.

7. A noise attenuating apparatus according to claim 1, wherein said passage of said outlet means comprises a plurality of spaced apart apertures formed in said shroud, said apertures being in communication with said second chamber and said ambient environment.

8. A noise attenuating apparatus comprising:

(a) a shroud;

(b) an innermost chamber formed in said shroud at least by a first chamber wall mounted within said shroud and having inlet means in communication therewith for receiving a fluid flow into said innermost chamber;

(c) at least one intermediate chamber formed within said shroud, at least a portion of said intermediate chamber being defined by said first chamber wall which is disposed between said intermediate chamber and said innermost chamber and a second chamber wall disposed within said shroud;

(d) an outermost chamber formed by said shroud and said second chamber wall which is disposed between said outermost chamber and said intermediate chamber; said outermost chamber having outlet means in communication therewith for communicating said outermost chamber with the ambient environment;

(e) first communicating means for providing communication between said innermost chamber and said intermediate chamber for passage of the fluid flow from said inlet means to said intermediate chamber; and (f) second communicating means for providing communication between said intermediate chamber and said outermost chamber for passage of the fluid flow from said intermediate chamber to said outermost chamber; wherein said first and second communicating means each comprise one or more sound attenuators connected respectively to said first and second chamber walls wherein each said sound attenuator has a passage therethrough which extends between a first orifice closest to said inlet means and a corresponding second orifice farthest away from said inlet means, each said sound attenuator being tapered so as to narrow between said first orifice and said second orifice wherein the size of said first orifice is larger than the size of said second orifice so that noise generated by the fluid flow therethrough is attenuated, said first communicating means having said first orifice thereof in communication with said innermost chamber to receive the fluid flow from said inlet means and having said second orifice thereof in communication with said intermediate chamber, said second communicating means having said first orifice thereof in communication with said intermediate chamber and having said second orifice thereof in communication with said outermost chamber.

9. A noise attenuating apparatus according to claim 8, wherein the intermediate chamber consists of one chamber.

10. A noise attenuating apparatus according to claim 8, wherein each said sound attenuator is conical shaped.

11. A noise attenuating apparatus according to claim 8, wherein each of said first and second walls includes a plurality of said sound attenuators.

12. A noise attenuating apparatus according to claim 8, wherein each of said sound attenuators has an imperforate annular side wall which tapers from said first orifice to said second orifice to define said passage therethrough.

13. A noise attenuating apparatus comprising a chamber wall which defines an interior chamber therein and includes inlet and outlet means defining passages through said chamber wall respectively for a fluid flow into and out of said interior chamber, wherein said outlet means comprise a plurality of sound attenuators connected to said chamber wall wherein each said sound attenuator has a first orifice closest to said inlet means in communication with said interior chamber and a corresponding second orifice farthest away from said inlet means, each said sound attenuator having an annular side wall tapering without flare from said first orifice to said second orifice wherein the size of said first orifice closest to said inlet means is larger than the size of the second orifice farthest away from said inlet means, said annular side wall being elongate so that said side wall reflects sound waves during passage therethrough to effect destructive resistance of said sound waves, said sound attenuators protecting away from said chamber wall.

14. A noise attenuating chamber according to claim 13, wherein said outlet means include an outlet port defining a passage through said chamber wall for controlling a back-pressure within said interior chamber from the fluid flow.

15. A noise attenuating apparatus comprising:

an enclosure which defines a hollow interior and includes an inlet for receiving a fluid flow into said hollow interior and an outlet for passage of said fluid flow out of said hollow interior; and said hollow interior including a plurality of hollow expansion chambers wherein first and second ones of said chambers are in communication with said inlet and said outlet respectively, each one of said chambers being separated from an adjacent one of said chambers by a plate-like dividing wall therebetween which includes a plurality of elongate conical sound attenuators that project longitudinally away from said dividing wall, a fluid flow path being defined which extends from said inlet through said sound attenuators and to said outlet, each of said sound attenuators including a first orifice and a second orifice which is smaller than said first orifice wherein said fluid flow path passes through said sound attenuator and exits through said second orifice thereof, each of said sound attenuators further including an annular side wall which has an interior surface that tapers without flare so as to narrow in a downstream direction extending away from said first orifice, said side wall being substantially imperforate between said first and second orifices such that reflected sound waves are reflected by said interior surface to generate a destructive resistance pattern of sound waves and attenuate noise generated by a fluid flow during passage through said sound attenuator, each of said first and second orifices being smaller than said inlet opening and said outlet opening.

16. A noise attenuating apparatus according to claim 15, wherein at least a third chamber is defined between said first and second chambers, said first to third chambers being in communication with each other by said sound attenuators.

* * * * *

UNITED STATES PATENT AND TRADEMARK OFFICE

CERTIFICATE OF CORRECTION

PATENT NO. : 5,760,348

DATED : June 2, 1998

INVENTOR(S) : Stephen Glen HEUSER

It is certified that error appears in the above-indentified patent and that said Letters Patent is hereby corrected as shown below:

Column 5, line 35; change "attenuators" to ---attenuator,---.

Column 5, line 48; change "Claim 1" to ---Claim 1,---.

Signed and Sealed this

Twenty-seventh Day of October, 1998

*Attest:*

Bruce Lehman

BRUCE LEHMAN

*Attesting Officer*

*Commissioner of Patents and Trademarks*